US008776755B2

(12) United States Patent
Müller et al.

(10) Patent No.: US 8,776,755 B2
(45) **Date of Patent: *Jul. 15, 2014**

(54) SOUND TRANSMISSION SYSTEM

(75) Inventors: Bernd Müller, Wiernsheim (DE); Heike Görner, Wiernsheim (DE)

(73) Assignee: Dr. Ing. h.c. F. Porsche Aktiengeselleschaft, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/540,100

(22) Filed: Jul. 2, 2012

(65) Prior Publication Data

US 2013/0008402 A1 Jan. 10, 2013

(30) Foreign Application Priority Data

Jul. 8, 2011 (DE) ..... 10 2011 051 689

(51) Int. Cl.
*F02M 35/10* (2006.01)

(52) U.S. Cl.
USPC ..... 123/184.57; 123/184.53

(58) Field of Classification Search
USPC ..... 123/184.57, 198 E, 184.53; 340/384.1, 340/438, 439; 181/204
See application file for complete search history.

(56) References Cited

U.S. PATENT DOCUMENTS

| | | | | |
|---|---|---|---|---|
| 2,822,885 | A | 2/1958 | Sebok et al. | |
| 3,990,414 | A | 11/1976 | Malphettes | |
| 6,105,546 | A | 8/2000 | Fuesser et al. | |
| 6,116,026 | A | 9/2000 | Freese | |
| 6,135,079 | A | 10/2000 | Fuesser | |
| 6,600,408 | B1 * | 7/2003 | Walter et al. | 340/384.1 |
| 6,644,436 | B2 * | 11/2003 | Hofmann et al. | 181/214 |
| 6,848,410 | B2 * | 2/2005 | Hoffmann et al. | 123/184.57 |
| 7,080,619 | B2 | 7/2006 | Kino et al. | |
| 7,165,525 | B2 | 1/2007 | Vogel | |
| 7,353,791 | B2 * | 4/2008 | Sasaki et al. | 123/184.57 |
| 7,448,353 | B2 * | 11/2008 | Shinada et al. | 123/184.57 |
| 7,975,802 | B2 * | 7/2011 | Yokoya et al. | 181/160 |
| 8,381,871 | B1 | 2/2013 | Hellie et al. | |

(Continued)

FOREIGN PATENT DOCUMENTS

| | | | |
|---|---|---|---|
| CN | 1945000 | A | 4/2007 |
| DE | 10114397 | A1 | 9/2002 |

(Continued)

OTHER PUBLICATIONS

Search Report from German priority application De 10 2011 051 689.1, dated Mar. 22, 2012, with partial English translation.

(Continued)

*Primary Examiner* — Hung Q Nguyen
(74) *Attorney, Agent, or Firm* — RatnerPrestia

(57) ABSTRACT

A sound transmission system of a motor vehicle, having an intake sound transmission device which can be coupled via a first tubular connecting element to an air intake manifold which leads to an internal combustion engine and via a second tubular connecting element to a vehicle interior, the first tubular connecting element being assigned a first switchable shut-off device, having a resonator device which interacts with the intake sound transmission device and can be coupled via a third tubular connecting element to the air intake manifold which leads to an internal combustion engine, the third tubular connecting element being assigned a second switchable shut-off device.

9 Claims, 1 Drawing Sheet

(56) References Cited

U.S. PATENT DOCUMENTS

| | | | | |
|---|---|---|---|---|
| 2004/0094112 | A1 | 5/2004 | Hoffmann et al. | |
| 2004/0231912 | A1 | 11/2004 | Fukumoto | |
| 2006/0180119 | A1 | 8/2006 | Winstead | |
| 2007/0079784 | A1 * | 4/2007 | Sasaki et al. | 123/184.53 |
| 2007/0131189 | A1 | 6/2007 | Shinada et al. | |
| 2008/0173271 | A1 | 7/2008 | Prior et al. | |
| 2009/0000587 | A1 | 1/2009 | Seko et al. | |
| 2009/0250290 | A1 | 10/2009 | Jasnie et al. | |
| 2011/0000186 | A1 | 1/2011 | Laube et al. | |
| 2011/0108358 | A1 | 5/2011 | Edgington et al. | |
| 2013/0008402 | A1 | 1/2013 | Müller et al. | |
| 2013/0008737 | A1 | 1/2013 | Müller et al. | |

FOREIGN PATENT DOCUMENTS

| | | | |
|---|---|---|---|
| DE | 10310487 | A1 | 9/2004 |
| DE | 102008002314 | A1 | 2/2009 |
| JP | S60-153870 | | 10/1985 |
| JP | H03-87930 | | 9/1991 |
| JP | 2003-262166 | | 9/2003 |
| JP | 2009-030451 | A | 2/2009 |

OTHER PUBLICATIONS

Notice of Allowance in U.S. Appl. No. 13/540,108 dated Nov. 14, 2013.

English translation of Japanese Office Action issued Jan. 30, 2014 in corresponding Japanese Application No. 2012-152185.

* cited by examiner

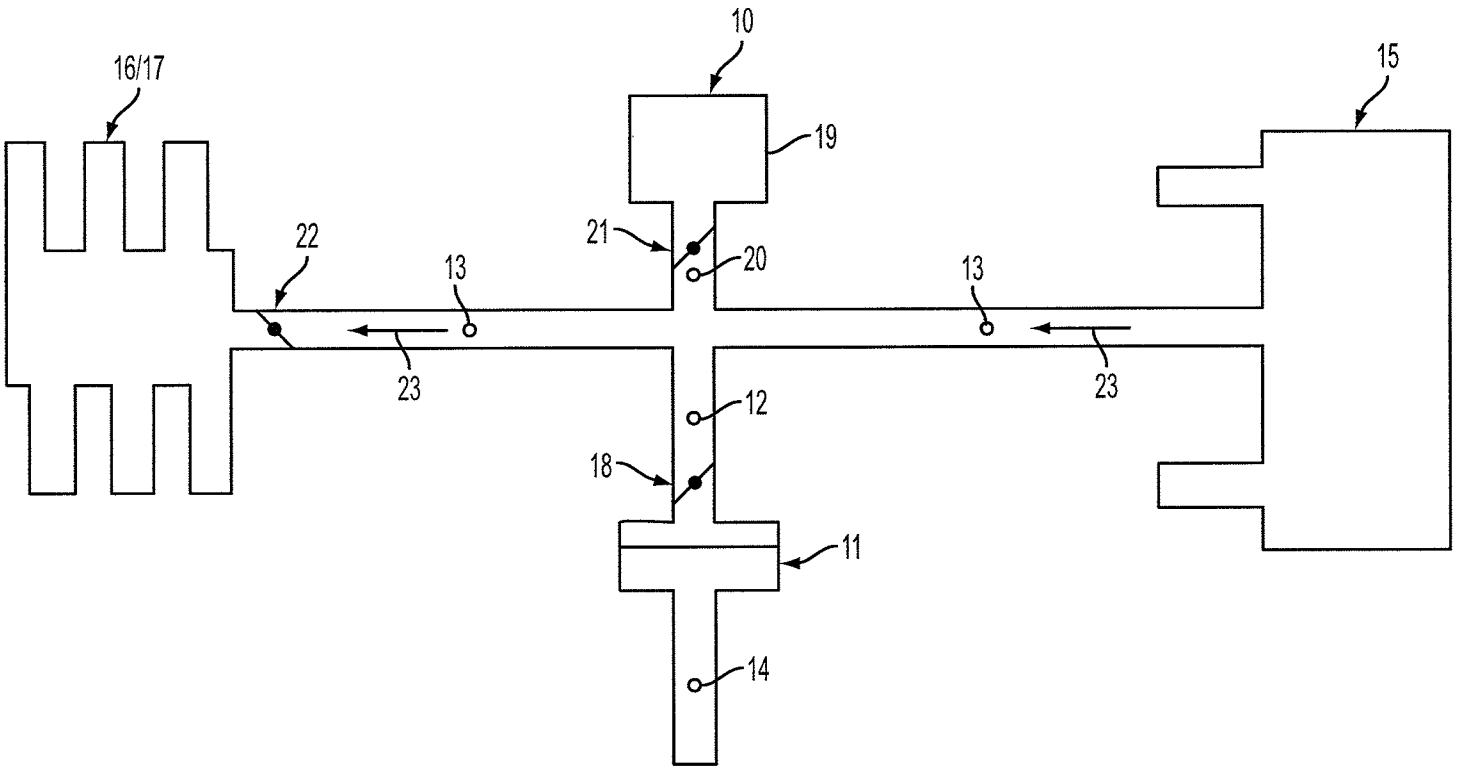
15
23
13
19
10
20
21
12
18
11
14
13
23
22
16/17

SOUND TRANSMISSION SYSTEM

CROSS-REFERENCE TO RELATED APPLICATION

This U.S. patent application claims priority to German Patent Application DE 10 2011 051 689.1, filed Jul. 8, 2011, which is incorporated by reference herewith in its entirety.

FIELD OF INVENTION

The invention relates to a sound transmission system having an intake sound transmission device which can be coupled via a first tubular connecting element to an air intake manifold which leads to an internal combustion engine and via a second tubular connecting element to a vehicle interior, the first tubular connecting element being assigned a first switchable shut-off device.

BACKGROUND

DE 103 10 487 A1 has disclosed a sound transmission system of a motor vehicle, in order to set, in an interior of the motor vehicle, a defined sound level to be transmitted from the internal combustion engine into the interior of the motor vehicle. According to DE 103 10 487 A1, the sound transmission system comprises an intake sound transmission device which can be coupled via a first tubular connecting element to an air intake manifold which leads to an internal combustion engine and via a second tubular connecting element to a vehicle interior of the motor vehicle. DE 103 10 487 A1 discloses, furthermore, assigning a switchable shut-off device to the first tubular connecting element, via which the intake sound transmission device can be coupled to the air intake manifold which leads to the internal combustion engine. Here, according to this prior art, the intake sound transmission device is decoupled substantially from the intake sound of the internal combustion engine when the shut-off device is closed, whereas, when the shut-off device is open, the intake sound transmission device is coupled to the intake sound of the internal combustion engine.

Although an interior sound level can already be set in the interior of the motor vehicle by way of the sound transmission system which is known from the prior art, there is a requirement for a novel sound transmission system, by way of which more differentiated influencing of the interior sound level is possible.

SUMMARY

Proceeding herefrom, the present invention is based on the object of providing a novel sound transmission system. This object is achieved by a sound transmission system having an intake sound transmission device which can be coupled via a first tubular connecting element to an air intake manifold which leads to an internal combustion engine and via a second tubular connecting element to a vehicle interior, the first tubular connecting element being assigned a first switchable shut-off device, wherein a resonator device which interacts with the intake sound transmission device and can be coupled via a third tubular connecting element to the air intake manifold which leads to an internal combustion engine, the third tubular connecting element being assigned a second switchable shut-off device. The sound transmission system according to aspects of the invention comprises a resonator device which interacts with the intake sound transmission device and can be coupled via a third tubular connecting element to the air intake manifold which leads to an internal combustion engine, the third tubular connecting element being assigned a second switchable shut-off device.

In the sound transmission system according to aspects of the invention, the intake sound transmission device interacts with the resonator device which can be coupled via a third tubular connecting element to the air intake manifold which leads to the internal combustion engine. Here, said third tubular connecting element is assigned the second switchable shut-off device.

As a result of the interaction of the intake sound transmission device and the resonator device depending on the switching position of the switchable shut-off devices, more differentiated influencing of an interior sound level is possible, to be precise in a simple and reliable way.

According to one advantageous development, the first switchable shut-off device and the second switchable shut-off device can be actuated in such a way that, in a first switching position combination, the first switchable shut-off device is closed and the second switchable shut-off device is open, that, in a second switching position combination, the first switchable shut-off device and the second switchable shut-off device are in each case closed, that, in a third switching position combination, the first switchable shut-off device and the second switchable shut-off device are in each case open, and that, in a fourth switching position combination, the first switchable shut-off device is open and the second switchable shut-off device is closed. In the above way, four different interior sound levels can be set simply and reliably in the interior of the motor vehicle.

BRIEF DESCRIPTION OF THE DRAWINGS

Preferred developments of the invention result from the subclaims and the following description. Without being restricted hereto, exemplary embodiments of the invention will be explained in greater detail using the drawing, in which:

FIG. 1 shows a diagrammatic illustration of a sound transmission system together with an internal combustion engine and an air filter.

DETAILED DESCRIPTION

The present invention relates to a sound transmission system 10 of a motor vehicle.

Defined interior sound levels can be set in an interior of the motor vehicle by way of the sound transmission system 10, in order to impart different sounds which are dependent on an internal combustion engine of the motor vehicle to an occupant.

The sound transmission system 10 has an intake sound transmission device 11 which can be coupled via a first tubular connecting element 12 to an air intake manifold 13 and via a second tubular connecting element 14 to an interior (not shown) of the motor vehicle. The air intake manifold 13 leads from an air filter device 15 to an internal combustion engine 16, namely to an air intake system 17 of the internal combustion engine 16.

The intake sound transmission device 11 is also called a sound symposer and can be constructed as known from DE 103 10 487 A1.

According to FIG. 1, a first switchable shut-off device 18 is assigned to the first tubular connecting element 12, via which the intake sound transmission device 11 can be coupled to the air intake manifold 13. When the first shut-off device 18 is open, the intake sound transmission device 11 is coupled to intake sound of the internal combustion engine, namely to intake sound in the air intake manifold 13, whereas, when the first shut-off device 18 is closed, said intake sound transmission device 11 is substantially decoupled from said intake sound.

In addition to the intake sound transmission device 11, the sound transmission system 10 according to aspects of the invention has a resonator device 19 which interacts with the intake sound transmission device 11, the resonator device 19 preferably being a Helmholtz resonator.

The resonator device 19 is tuned to a defined frequency which is also called the tuning frequency. Thus, for example, the resonator device 19 can be tuned to a frequency of 240 Hz, in particular when said frequency is excited greatly in a defined rotational speed range of the internal combustion engine by an order of vibration of the latter, for example the third order of engine vibration.

The resonator device 19 can be coupled via a third tubular connecting element 20 to the air intake manifold 13 which leads to the internal combustion engine 16; likewise, the intake sound transmission device 11 can be coupled via the first tubular connecting element 12. Here, for the function of the resonator device 19, the third tubular connecting element 20 can be tuned with regard to its length and diameter to the volumetric size of the resonator device 19.

The third tubular connecting element 20, via which the resonator device 19 can be coupled to the intake manifold 13, is assigned a second shut-off device 21 which is of switchable configuration, just like the first shut-off device 18 which is assigned to the first tubular connecting element 12.

When the second switchable shut-off device 21 is open, the resonator device 19 is coupled to intake sound in the intake manifold 13, whereas the resonator device 19 is substantially decoupled from intake sound in the intake manifold 13 when the second shut-off device 21 is closed.

An interior sound level in the interior of the motor vehicle can be influenced directly or immediately via the intake sound transmission device 11. Via the resonator device 19 which is preferably configured as a Helmholtz resonator, the interior sound level in the interior of the motor vehicle can be influenced indirectly or not immediately via the intake sound transmission device 11.

The two switchable shut-off devices 18 and 21, namely the first shut-off device 18 which interacts with the intake sound transmission device 11 and the second shut-off device 21 which interacts with the resonator device 19, can be actuated and therefore switched in such a way that, in a first switching position combination, the first switchable shut-off device 18 is closed and the second switchable shut-off device 21 is open.

In the first switching position combination, accordingly, the intake sound transmission device 11 is substantially decoupled from the intake sound in the intake manifold 13 when the shut-off device 18 is closed, whereas the resonator device 19 is coupled to the intake sound in the intake manifold 13 when the second shut-off device 21 is open.

In a second switching position combination, both the first switchable shut-off device 18 and the second switchable shut-off device 21 are closed, both the intake sound transmission device 11 and the resonator device 19 then being substantially decoupled from the intake sound in the intake manifold 13.

In a third switching position combination, both switchable shut-off devices 18 and 21 are open, with the result that both the intake sound transmission device 11 and the resonator device 19 are then coupled to intake sound in the intake manifold 13.

In a fourth switching position combination, in which the first switchable shut-off device 18 is open and the second switchable shut-off device 21 is closed, the intake sound transmission device 11 is coupled to the intake sound in the intake manifold 13, whereas the resonator device 19 is substantially decoupled from said intake sound in the intake manifold 13.

The above four switching position combinations of the two switchable shut-off devices 18 and 21 are summarized in the following table:

| Switching position | Switchable shut-off device 18 of the intake sound transmission device 11 | | Switchable shut-off device 21 of the resonator device 19 | |
|---|---|---|---|---|
| combination | OPEN | CLOSED | OPEN | CLOSED |
| 1 | | X | X | |
| 2 | | X | | X |
| 3 | X | | X | |
| 4 | X | | | X |

The above first switching position combination, in which the first shut-off device 18 is closed and the second shut-off device 21 is open, serves to provide a first, relatively quiet interior sound level in the interior (not shown) of the motor vehicle, it being possible for said first interior sound level to be called a comfort sound level.

The above second switching position combination, in which both shut-off devices 18, 21 are closed, serves to provide a second interior sound level which is higher than the first interior sound level, it being possible for the second interior sound level to be called an intermediate sound level.

The above third switching position combination, in which both shut-off elements 18, 21 are open, serves to provide a third interior sound level which is higher than the second interior sound level and is therefore also higher than the first interior sound level, it also being possible for said third interior sound level to be called a sport sound level.

The above fourth switching position combination, in which the first shut-off device 18 is open and the second shut-off device 21 is closed, serves to provide a fourth interior sound level which is higher than the third interior sound level and is therefore also higher than the second and first interior sound levels, it also being possible for said fourth interior sound level to be called a racing interior sound level.

The two switchable shut-off devices 18, 21 are preferably configured as flaps which can be transferred between an open flap position and a closed flap position independently of one another.

As has already been described above, the first tubular connecting element 12, via which the intake sound transmission device 11 can be coupled to the air intake manifold 13, and the third tubular connecting element 20, via which the resonator device 19 can be coupled to the intake manifold 13, in each case act on the air intake manifold 13 which leads from the air filter device 15 to the internal combustion engine 16, namely to the air intake system 17 of the internal combustion engine 16, namely downstream of the air filter device 15 and upstream of a throttle valve 22 which is assigned to the air intake manifold 13. As can be gathered from FIG. 1, the first tubular connecting element 12 and the third tubular connecting element 20 act here on the air intake manifold 13, at an identical axial position in relation to a throughflow direction 23 of the air intake manifold 13.

The axial position, at which the first tubular connecting element 12 and the third tubular connecting element 20 act on the air intake manifold 13, is distinguished by a relatively high, preferably maximum, pressure oscillation amplitude in relation to the tuning frequency of the resonator device 19.

The first tubular connecting element 12 and the third tubular connecting element 20 act on the air intake manifold 13 at this axial position of the air intake manifold 13 with a circumferential offset which is, in particular, between 90° and 270°.

The present invention relates to a sound transmission system of a motor vehicle, having an intake sound transmission device 11 and a resonator device 19. The intake sound transmission device 11 can be coupled to the air intake manifold 13 via a first tubular connecting element 12, whereas the resonator device 19 can be coupled to the air intake manifold 13 via a third tubular connecting element 20. The intake sound transmission device 11 can be coupled to the interior of the motor vehicle via a second tubular connecting element 14.

Both the intake sound transmission device 11 and the resonator device 19 are in each case assigned a switchable shut-off device 18 and 21, respectively, the shut-off device 18 which is assigned to the intake sound transmission device 11 being assigned to the first tubular connecting element 12, and the shut-off device 21 which is assigned to the resonator device 19 being assigned to the third tubular connecting element 20. Said shut-off devices 18, 21 are preferably configured as switchable flaps, it being possible for a different interior sound level to be set in the vehicle interior of the motor vehicle depending on the switching position of said flaps and, accordingly, depending on a switching position combination of said flaps.

| List of Reference Numerals | |
|---|---|
| 10 | Sound transmission system |
| 11 | Intake sound transmission device |
| 12 | Connecting element |
| 13 | Intake manifold |
| 14 | Connecting element |
| 15 | Air filter device |
| 16 | Internal combustion engine |
| 17 | Air intake system |
| 18 | Shut-off device |
| 19 | Resonator device |
| 20 | Connecting element |
| 21 | Shut-off device |
| 22 | Throttle valve |
| 23 | Flow direction |

What is claimed:

1. A sound transmission system of a motor vehicle, comprising an intake sound transmission device that is coupled via a first tubular connecting element to an air intake manifold which leads to an internal combustion engine and via a second tubular connecting element to a vehicle interior, the first tubular connecting element having a first switchable shut-off device, and a resonator device having a tuning frequency which interacts with the intake sound transmission device and is coupled via a third tubular connecting element to the air intake manifold which leads to the internal combustion engine, the third tubular connecting element having a second switchable shut-off device, wherein the first tubular connecting element and the third tubular connecting element are coupled to the air intake manifold which leads to the internal combustion engine, in each case at an identical axial position of the air intake manifold in relation to a flow direction and with a circumferential offset relative to each other.

2. The sound transmission system as claimed in claim 1, wherein the resonator device is a Helmholtz resonator.

3. The sound transmission system as claimed in claim 1, wherein an interior sound in the vehicle interior can be influenced directly or immediately via the intake sound transmission device, and the interior sound can be influenced indirectly or not immediately via the resonator device.

4. The sound transmission system as claimed in claim 1, wherein the first switchable shut-off device and the second switchable shut-off device can be actuated in such a way that, in a first switching position combination, the first switchable shut-off device is closed and the second switchable shut-off device is open, that, in a second switching position combination, the first switchable shut-off device and the second switchable shut-off device are in each case closed, that, in a third switching position combination, the first switchable shut-off device and the second switchable shut-off device are in each case open, and that, in a fourth switching position combination, the first switchable shut-off device is open and the second switchable shut-off device is closed.

5. The sound transmission system as claimed in claim 4, wherein the first switching position combination serves to provide a first interior sound level, in that the second switching position combination serves to provide a second interior sound level which is higher than the first interior sound level, in that the third switching position combination serves to provide a third interior sound level which is higher than the second interior sound level, and in that the fourth switching position combination serves to provide a fourth interior sound level which is higher than the third interior sound level.

6. The sound transmission system as claimed in claim 1, wherein the first tubular connecting element and the third tubular connecting element are coupled to the air intake manifold which leads to the internal combustion engine, in each case upstream of a throttle valve which is assigned to the air intake manifold.

7. The sound transmission system as claimed in claim 1, wherein the first tubular connecting element and the third tubular connecting element are coupled to the air intake manifold which leads to the internal combustion engine, in each case downstream of an air filter device.

8. The sound transmission system as claimed in claim 1, wherein the first tubular connecting element and the third tubular connecting element are coupled to the air intake manifold at the identical axial position of the air intake manifold with a circumferential offset between 90° and 270°.

9. The sound transmission system as claimed in claim 1, wherein the first tubular connecting element and the third tubular connecting element are coupled to the air intake manifold which leads to the internal combustion engine, at the axial position of the air intake manifold with a relatively high pressure oscillation amplitude in relation to the tuning frequency of the resonator device.

* * * * *